US011831090B2

(12) United States Patent
Hasnat et al.

(10) Patent No.: US 11,831,090 B2
(45) Date of Patent: Nov. 28, 2023

(54) ELECTRONIC DEVICES WITH DISPLAY-OVERLAPPING ANTENNAS

(71) Applicant: Apple Inc., Cupertino, CA (US)

(72) Inventors: Forhad Hasnat, Cupertino, CA (US); David Garrido Lopez, Campbell, CA (US); Harish Rajagopalan, San Jose, CA (US); Mikal Askarian Amiri, Tempe, AZ (US); Rodney A. Gomez Angulo, Santa Clara, CA (US); Lu Zhang, Shanghai (CN)

(73) Assignee: Apple Inc., Cupertino, CA (US)

( * ) Notice: Subject to any disclaimer, the term of this patent is extended or adjusted under 35 U.S.C. 154(b) by 351 days.

(21) Appl. No.: 16/903,198

(22) Filed: Jun. 16, 2020

(65) Prior Publication Data

US 2021/0391651 A1 Dec. 16, 2021

(51) Int. Cl.

| | |
|---|---|
| ***H01Q 1/24*** | (2006.01) |
| ***H01Q 9/40*** | (2006.01) |
| ***H01Q 7/00*** | (2006.01) |
| ***H01Q 13/22*** | (2006.01) |

(52) U.S. Cl.

CPC ..... *H01Q 9/40* (2013.01); *H01Q 1/243* (2013.01); *H01Q 7/00* (2013.01); *H01Q 13/22* (2013.01)

(58) Field of Classification Search

CPC ..... H01Q 9/40; H01Q 1/243; H01Q 7/00; H01Q 13/22; H01Q 13/18; H01Q 9/42

See application file for complete search history.

(56) References Cited

U.S. PATENT DOCUMENTS

| | | | | |
|---|---|---|---|---|
| 4,814,776 | A * | 3/1989 | Caci | H01Q 7/00 343/702 |
| 5,933,330 | A | 8/1999 | Beutler et al. | |
| 8,805,272 | B2 | 8/2014 | Kawamura | |
| 9,153,856 | B2 * | 10/2015 | Rappoport | H01Q 1/48 |
| 9,354,673 | B2 | 5/2016 | Sakakibara et al. | |
| 10,158,384 | B1 * | 12/2018 | Yarga | H04B 1/0458 |
| 10,193,597 | B1 * | 1/2019 | Garrido Lopez | H04B 1/38 |
| 10,200,105 | B2 | 2/2019 | Hu et al. | |
| 10,218,052 | B2 | 2/2019 | Pascolini et al. | |
| 10,320,069 | B2 | 6/2019 | Zhou et al. | |
| 10,355,344 | B1 | 7/2019 | Ruaro et al. | |

(Continued)

FOREIGN PATENT DOCUMENTS

WO WO-2014203967 A1 * 12/2014 ..... H01Q 1/243

*Primary Examiner* — Hai V Tran
*Assistant Examiner* — Bamidele A Jegede
(74) *Attorney, Agent, or Firm* — Treyz Law Group, P.C.; Michael H. Lyons; Tianyi He

(57) ABSTRACT

An electronic device may include a conductive housing with a rear wall and a sidewall. A display may be mounted to the sidewall and may include a conductive display structure separated from the sidewall by a slot. An antenna arm may be interposed between the conductive display structure and the rear wall. A first inductor may couple the conductive display structure to the housing and may compensate for a distributed capacitance between the antenna arm and the conductive display structure. A second inductor may couple the antenna arm to the rear wall and may compensate for a distributed capacitance between the antenna arm and the rear wall. A speaker may be co-located with the antenna. A third inductor may couple the antenna arm to the rear wall to allow antenna currents to bypass the speaker.

20 Claims, 9 Drawing Sheets

(56) References Cited

U.S. PATENT DOCUMENTS 10,490,881 B2 11/2019 Azad et al.
10,629,982 B2 4/2020 Kim et al.
2008/0165065 A1* 7/2008 Hill ..... H01Q 13/10 343/702
2009/0009007 A1* 1/2009 Kato ..... H05K 1/0239 307/104
2009/0295646 A1* 12/2009 Oh ..... H01Q 9/30 343/702
2011/0012793 A1* 1/2011 Amm ..... H01Q 1/243 343/702
2012/0050114 A1* 3/2012 Li ..... H01Q 1/44 343/702
2012/0154245 A1* 6/2012 Nagumo ..... H01Q 1/243 343/861
2012/0214412 A1* 8/2012 Schlub ..... H03K 17/955 455/41.1
2012/0229347 A1* 9/2012 Jin ..... H01Q 21/28 343/702
2012/0229349 A1* 9/2012 Badaruzzaman ..... H01Q 5/371 343/702
2012/0231750 A1* 9/2012 Jin ..... H01Q 7/005 343/702
2013/0249742 A1* 9/2013 Yukimoto ..... H01Q 1/2283 343/700 MS
2013/0265207 A1* 10/2013 Yukimoto ..... H01Q 9/42 343/860
2014/0015721 A1* 1/2014 Yukimoto ..... H01Q 9/42 343/749
2014/0203981 A1* 7/2014 Nakano ..... G06K 19/07794 343/749
2015/0311881 A1* 10/2015 Nagumo ..... H01Q 1/50 343/861
2016/0104944 A1* 4/2016 Rajagopalan ..... H01Q 5/378 343/725
2016/0308271 A1* 10/2016 Jin ..... H01Q 1/48
2016/0336643 A1* 11/2016 Pascolini ..... H01Q 9/0421
2017/0040668 A1* 2/2017 Ayala Vazquez .... H01Q 13/106
2019/0027808 A1* 1/2019 Mow ..... H04R 5/04
2019/0074586 A1* 3/2019 Ruaro ..... H01Q 9/04
2019/0081385 A1* 3/2019 Avser ..... H01Q 5/328
2019/0081386 A1* 3/2019 Edwards ..... H01Q 5/328
2019/0081393 A1* 3/2019 Zhou ..... H05K 5/0017
2019/0081394 A1* 3/2019 Edwards ..... H01Q 1/48
2019/0081396 A1* 3/2019 Zhou ..... H04M 1/02
2019/0081410 A1* 3/2019 Zhou ..... H01Q 1/2258
2019/0081694 A1* 3/2019 Zhou ..... H05K 1/165
2019/0097306 A1* 3/2019 Romano ..... H01Q 13/10
2019/0113609 A1* 4/2019 Baheti ..... H01Q 9/045
2019/0372205 A1* 12/2019 Ruaro ..... H01Q 13/10
2019/0393586 A1 12/2019 Ayala Vazquez et al.
2020/0007184 A1 1/2020 Jung et al.
2020/0089287 A1 3/2020 Oster et al.
2020/0099138 A1 3/2020 Garrido Lopez et al.

* cited by examiner

ELECTRONIC DEVICES WITH DISPLAY-OVERLAPPING ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies with satisfactory efficiency bandwidth.

It would therefore be desirable to be able to provide improved wireless communications circuitry for wireless electronic devices.

SUMMARY

An electronic device may be provided with a housing, a display, and wireless circuitry. The wireless circuitry may include one or more antennas. The housing may include a conductive sidewall and a conductive rear wall. The display may include a conductive display structure and a display cover layer overlapping the conductive display structure. The display may be mounted to the conductive sidewall. A periphery of the conductive display structure may be separated from the conductive sidewall by a slot. The conductive display structure and the conductive rear wall may define opposing edges of an interior cavity of the device.

A dielectric substrate may be mounted to the conductive rear wall within the interior cavity. A planar inverted-F antenna may be formed from a conductive structure layered over the dielectric substrate. An entirety of the planar inverted-F antenna may be interposed between the conductive display structure and the conductive rear wall, if desired. The antenna may have an antenna arm formed on a top surface of the dielectric substrate. A first inductor may be coupled between the conductive display structure and the housing. The first inductor may compensate for detuning of the antenna by a distributed capacitance between the antenna arm and the conductive display structure. The antenna arm may be coupled to the conductive rear wall by a second inductor. The second inductor may compensate for detuning of the antenna by a distributed capacitance between the antenna arm and the conductive rear housing wall. The antenna may radiate through the slot and the display cover layer.

If desired, the antenna may include a third inductor that couples the antenna arm to the conductive rear housing wall. A first portion of the antenna arm, the second inductor, and a first portion of the conductive rear housing wall may form a first current loop path for the antenna. A second portion of the antenna arm, the third inductor, and a second portion of the conductive rear housing wall may form a second current loop path for the antenna. The first and second current loop paths may contribute to the radiative response of the antenna. A device component such as a speaker may be co-located with the antenna. The speaker may be mounted within a notch in the dielectric substrate. The second portion of the antenna arm may extend along opposing sides of the speaker. The second and third inductors and the antenna arm may be formed from respective portions of the conductive structure layered over the dielectric substrate.

DETAILED DESCRIPTION

Figure 1:
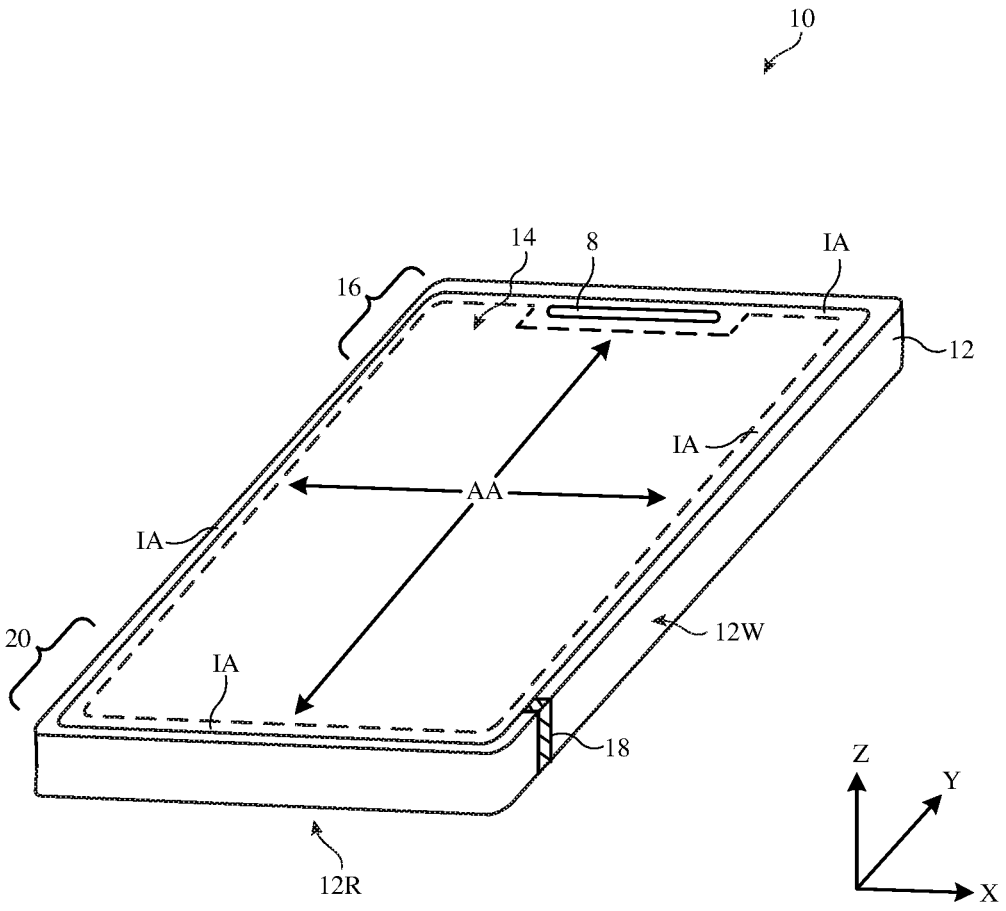
FIG. 1 is a perspective view of an illustrative electronic device in accordance with some embodiments.

An electronic device such as electronic device 10 of FIG. 1 may be provided with wireless circuitry that includes antennas. The antennas may be used to transmit and/or receive wireless radio-frequency signals.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as conductive sidewalls, peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Conductive sidewalls 12W may be formed from a metal such as stainless steel, aluminum, or other suitable materials. One, two, or more than two separate structures may be used in forming conductive sidewalls 12W.

It is not necessary for conductive sidewalls 12W to have a uniform cross-section. For example, the top portion of conductive sidewalls 12W may, if desired, have an inwardly protruding lip that helps hold display 14 in place. The bottom portion of conductive sidewalls 12W may also have an enlarged lip (e.g., in the plane of the rear surface of device 10). Conductive sidewalls 12W may have substantially straight vertical sidewalls, may have sidewalls that are curved, or may have other suitable shapes. In some configurations (e.g., when conductive sidewalls 12W serve as a bezel for display 14), conductive sidewalls 12W may run around the lip of housing 12 (i.e., conductive sidewalls 12W may cover only the edge of housing 12 that surrounds display 14 and not the rest of the sidewalls of housing 12).

If desired, rear housing wall 12R may be formed from a metal such as stainless steel or aluminum and may sometimes be referred to herein as conductive rear housing wall 12R or conductive rear wall 12R. Conductive rear housing wall 12R may lie in a plane that is parallel to display 14. In configurations for device 10 in which the rear housing wall is formed from metal, it may be desirable to form parts of conductive sidewalls 12W as integral portions of the housing structures forming the conductive rear housing wall of housing 12. For example, conductive rear housing wall 12R of device 10 may be formed from a planar metal structure and portions of conductive sidewalls 12W on the sides of housing 12 may be formed as flat or curved vertically extending integral metal portions of the planar metal structure (e.g., housing structures 12R and 12W may be formed from a continuous piece of metal in a unibody configuration) . Housing structures such as these may, if desired, be machined from a block of metal and/or may include multiple metal pieces that are assembled together to form housing 12. Conductive rear housing wall 12R may have one or more, two or more, or three or more portions. Conductive sidewalls 12W and/or the conductive rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 12W and/or 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 8 or a microphone port. Speaker port 8 may be omitted if desired. Openings may be formed in housing 12 to form communications ports (e.g., an audio jack port, a digital data port, etc.) and/or audio ports for audio components such as a speaker and/or a microphone if desired.

Display 14 may include a display module having conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of conductive sidewalls 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

At ends (regions) 16 and 20, openings may be formed within the conductive structures of device 10 (e.g., between conductive sidewalls 12W and opposing conductive ground structures such as conductive portions of conductive rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in ends 20 and 16 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in ends 20 and 16. If desired, the ground plane that is under active area AA of display 14 and/or other metal structures in device 10 may have portions that extend into parts of the ends of device 10 (e.g., the ground may extend towards the dielectric-filled openings in ends 20 and 16), thereby narrowing the slots in ends 20 and 16.

In general, device 10 may include any suitable number of antennas (e.g., one or more, two or more, three or more, four or more, etc.). The antennas in device 10 may be located at opposing first and second ends of an elongated device housing (e.g., at ends 20 and 16 of device 10 of FIG. 1), along one or more edges of a device housing, in the center of a device housing, in other suitable locations, or in one or more of these locations. The arrangement of FIG. 1 is merely illustrative.

Portions of conductive sidewalls 12W may be provided with peripheral gap structures. For example, conductive sidewalls 12W may be provided with one or more gaps such as gaps 18, as shown in FIG. 1. The gaps in conductive sidewalls 12W may be filled with dielectric such as polymer, ceramic, glass, air, other dielectric materials, or combinations of these materials. Gaps 18 may divide conductive sidewalls 12W into one or more peripheral conductive segments. There may be, for example, two peripheral conductive segments in conductive sidewalls 12W (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of conductive sidewalls 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into conductive sidewalls 12W and may form antenna slots, gaps 18, and other structures in device 10. Polymer or other dielectric may fill these grooves and other housing openings. In some situations, housing openings that form antenna slots and other structures may be filled with a dielectric such as air.

In a typical scenario, device 10 may have one or more upper antennas and one or more lower antennas (as an example). An upper antenna may, for example, be formed at upper end 16 of device 10. A lower antenna may, for example, be formed at lower end 20 of device 10. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area of ends 20 and 16 that is available for forming antennas within device 10. In general, antennas that are provided with larger operating volumes or spaces may have higher bandwidth efficiency than antennas that are provided with smaller operating volumes or spaces. If care is not taken, increasing the size of active area AA may reduce the operating space available to the antennas, which can undesirably inhibit the efficiency bandwidth of the antennas (e.g., such that the antennas no longer exhibit satisfactory radio-frequency performance). It would therefore be desirable to be able to provide antennas that occupy a small amount of space within device 10 (e.g., to allow for as large of a display active area AA as possible) while still allowing the antennas to operate with optimal efficiency bandwidth.

Figure 2:
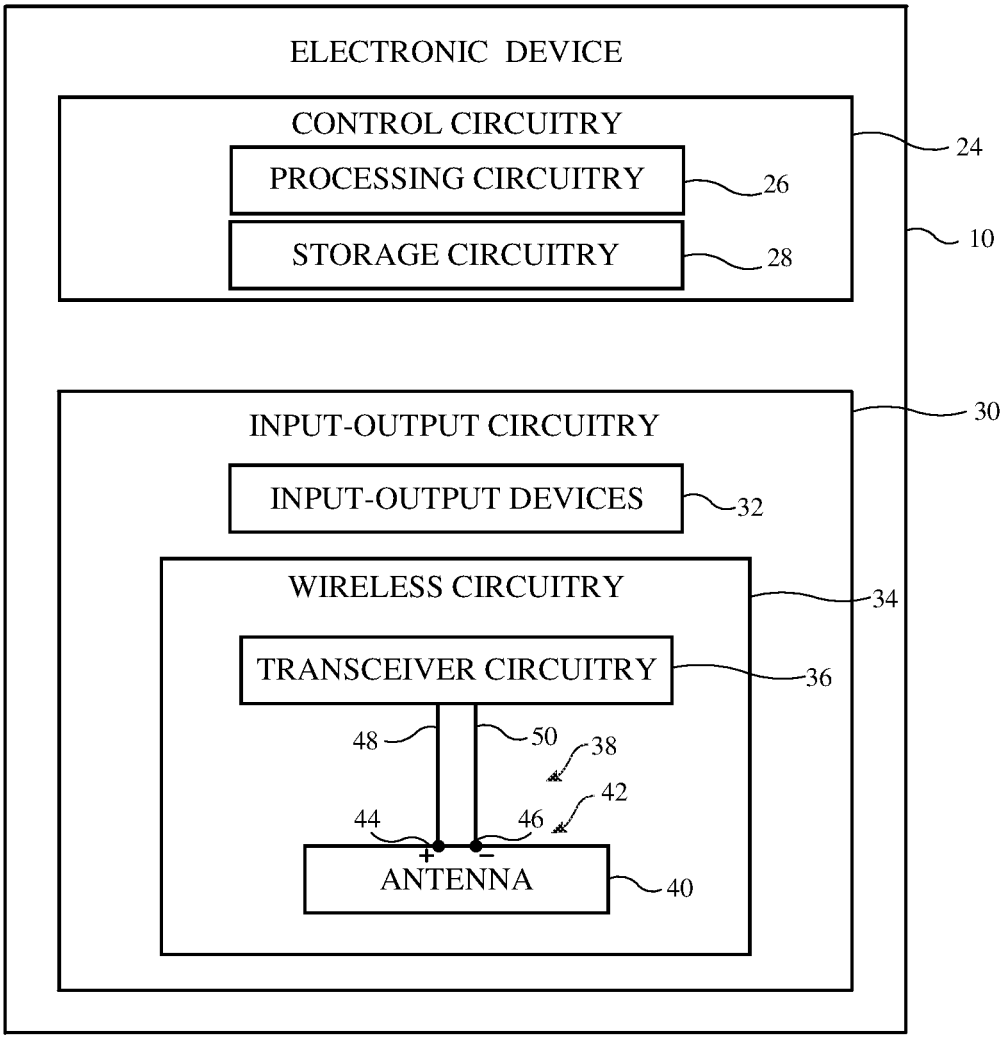
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 24. Control circuitry 24 may include storage such as storage circuitry 28. Storage circuitry 28 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 24 may include processing circuitry such as processing circuitry 26. Processing circuitry 26 may be used to control the operation of device 10. Processing circuitry 26 may include on one or more microprocessors, microcontrollers, digital signal processors, host processors, baseband processor integrated circuits, application specific integrated circuits, central processing units (CPUs), etc. Control circuitry 24 may be configured to perform operations in device 10 using hardware (e.g., dedicated hardware or circuitry), firmware, and/or software. Software code for performing operations in device 10 may be stored on storage circuitry 28 (e.g., storage circuitry 28 may include non-transitory (tangible) computer readable storage media that stores the software code). The software code may sometimes be referred to as program instructions, software, data, instructions, or code. Software code stored on storage circuitry 28 may be executed by processing circuitry 26.

Control circuitry 24 may be used to run software on device 10 such as satellite navigation applications, internet browsing applications, voice-over-internet-protocol (VOIP) telephone call applications, email applications, media playback applications, operating system functions, etc. To support interactions with external equipment, control circuitry 24 may be used in implementing communications protocols. Communications protocols that may be implemented using control circuitry 24 include internet protocols, wireless local area network (WLAN) protocols (e.g., IEEE 802.11 protocols—sometimes referred to as Wi-Fi®), protocols for other short-range wireless communications links such as the Bluetooth® protocol or other wireless personal area network (WPAN) protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), or any other desired communications protocols. Each communications protocol may be associated with a corresponding radio access technology (RAT) that specifies the physical connection methodology used in implementing the protocol.

Device 10 may include input-output circuitry 30. Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch sensors, displays (e.g., touch-sensitive displays), light-emitting components such as displays without touch sensor capabilities, buttons (mechanical, capacitive, optical, etc.), scrolling wheels, touch pads, key pads, keyboards, microphones, cameras, buttons, speakers, status indicators, audio jacks and other audio port components, digital data port devices, motion sensors (accelerometers, gyroscopes, and/or compasses that detect motion), capacitance sensors, proximity sensors, magnetic sensors, force sensors (e.g., force sensors coupled to a display to detect pressure applied to the display), etc. In some configurations, keyboards, headphones, displays, pointing devices such as trackpads, mice, and joysticks, and other input-output devices may be coupled to device 10 using wired or wireless connections (e.g., some of input-output devices 32 may be peripherals that are coupled to a main processing unit or other portion of device 10 via a wired or wireless link).

Input-output circuitry 30 may include wireless circuitry 34 to support wireless communications. Wireless circuitry 34 may include radio-frequency (RF) transceiver circuitry 36 formed from one or more integrated circuits, power amplifier circuitry, low-noise input amplifiers, passive RF components, one or more antennas such as antenna 40, transmission lines such as transmission line 38, and other circuitry for handling RF wireless signals. Wireless signals can also be sent using light (e.g., using infrared communications). While control circuitry 24 is shown separately from wireless circuitry 34 in the example of FIG. 1 for the sake of clarity, wireless circuitry 34 may include processing circuitry that forms a part of processing circuitry 26 and/or storage circuitry that forms a part of storage circuitry 28 of control circuitry 24 (e.g., portions of control circuitry 24 may be implemented on wireless circuitry 34). As an example, control circuitry 24 (e.g., processing circuitry 26) may include baseband processor circuitry or other control components that form a part of wireless circuitry 34.

Radio-frequency transceiver circuitry 36 may include wireless local area network transceiver circuitry that handles 2.4 GHz and 5 GHz bands for Wi-Fi® (IEEE 802.11) or other WLAN communications bands. Radio-frequency transceiver circuitry 36 may include wireless personal area network transceiver circuitry that handles the 2.4 GHz Bluetooth® communications band or other WPAN communications bands. If desired, radio-frequency transceiver circuitry 36 may handle other bands such as cellular telephone bands, near-field communications bands (e.g., at 13.56 MHz), millimeter or centimeter wave bands (e.g., communications at 10-300 GHz), and/or other communications bands. If desired, radio-frequency transceiver circuitry 36 may also include ultra-wideband (UWB) transceiver circuitry that supports communications using the IEEE 802.15.4 protocol and/or other ultra-wideband communications protocols. Communications bands may sometimes be referred to herein as frequency bands or simply as "bands" and may span corresponding ranges of frequencies.

Wireless circuitry 34 may include one or more antennas such as antenna 40. In general, radio-frequency transceiver circuitry 36 may be configured to cover (handle) any suitable communications (frequency) bands of interest. Radio-frequency transceiver circuitry 36 may convey radio-frequency signals using antennas 40 (e.g., antennas 40 may convey the radio-frequency signals for radio-frequency transceiver circuitry 36). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antenna.

As shown in FIG. 2, radio-frequency transceiver circuitry 36 may be coupled to antenna feed 42 of antenna 40 using transmission line 38. Antenna feed 42 may include a positive antenna feed terminal such as positive antenna feed terminal 44 and may include a ground antenna feed terminal such as ground antenna feed terminal 46. Transmission line 38 may be formed from metal traces on a printed circuit, cables, or other conductive structures. Transmission line 38 may have a positive transmission line signal path such as path 48 that is coupled to positive antenna feed terminal 44. Transmission line 38 may have a ground transmission line signal path such as path 50 that is coupled to ground antenna feed terminal 46. Path 48 may sometimes be referred to herein as signal conductor 48 and path 50 may sometimes be referred to herein as ground conductor 50.

Transmission line paths such as transmission line 38 may be used to route antenna signals within device 10 (e.g., to convey radio-frequency signals between radio-frequency transceiver circuitry 36 and antenna feed 42 of antenna 40). Transmission lines in device 10 may include coaxial cables, microstrip transmission lines, stripline transmission lines, edge-coupled microstrip transmission lines, edge-coupled stripline transmission lines, transmission lines formed from combinations of transmission lines of these types, etc. Transmission lines in device 10 such as transmission line 38 may be integrated into rigid and/or flexible printed circuit boards. In one suitable arrangement, transmission lines such as transmission line 38 may also include transmission line conductors (e.g., signal conductors 48 and ground conductors 50) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Filter circuitry, switching circuitry, impedance matching circuitry, and other circuitry may be interposed within the paths formed using transmission lines such as transmission line 38 and/or circuits such as these may be incorporated into antenna 40 (e.g., to support antenna tuning, to support operation in desired frequency bands, etc.). During operation, control circuitry 24 may use radio-frequency transceiver circuitry 36 and antenna(s) 40 to transmit and/or receive data wirelessly. Control circuitry 24 may, for example, receive wireless local area network communications wirelessly using radio-frequency transceiver circuitry 36 and antenna(s) 40 and may transmit wireless local area network communications wirelessly using radio-frequency transceiver circuitry 36 and antenna(s) 40.

Antennas such as antenna 40 may be formed using any suitable antenna types. For example, antennas in device 10 may include antennas with resonating elements that are formed from loop antenna structures, patch antenna structures, inverted-F antenna structures, slot antenna structures, planar inverted-F antenna structures, helical antenna structures, monopole antenna structures, strip antenna structures, dipole antenna structures, hybrids of these designs, etc. Parasitic elements may be included in antennas 40 to adjust antenna performance. If desired, antenna 40 may be provided with a conductive cavity that backs the antenna resonating element of antenna 40 (e.g., antenna 40 may be a cavity-backed antenna such as a cavity-backed slot antenna). Different types of antennas may be used for different bands and combinations of bands. For example, one type of antenna may be used in forming a local wireless link antenna and another type of antenna may be used in forming a remote wireless link antenna. In some configurations, different antennas may be used in handling different bands for radio-frequency transceiver circuitry 36. Alternatively, a given antenna 40 may cover one or more bands.

Figure 3:
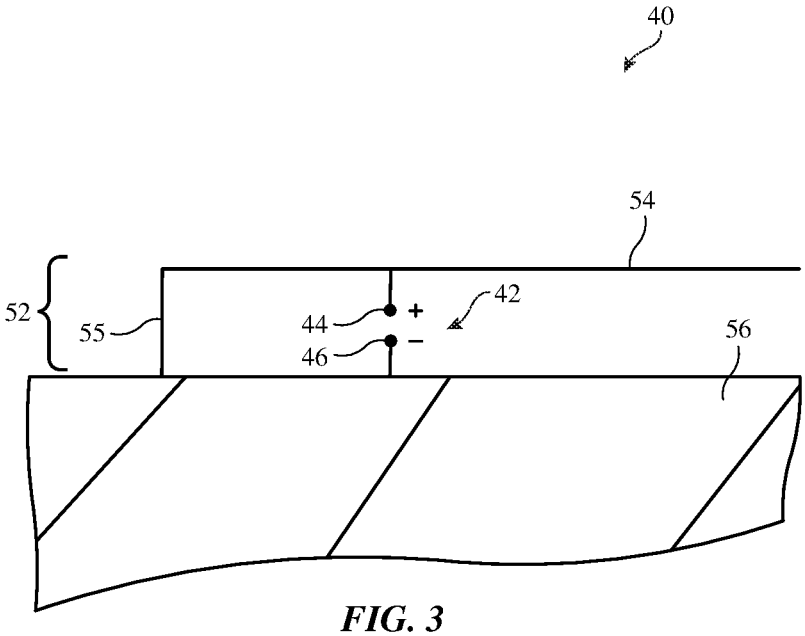
FIG. 3 is a schematic diagram of illustrative inverted-F antenna structures in accordance with some embodiments.

In one suitable arrangement that is sometimes described herein as an example, planar inverted-F antenna structures may be used for implementing antennas 40. Antennas that are implemented using planar inverted-F antenna structures may sometimes be referred to herein as planar inverted-F antennas. FIG. 3 is a schematic diagram of inverted-F antenna structures that may be used to form antenna 40. As shown in FIG. 3, antenna 40 may include an antenna resonating element such as antenna resonating element 52 and an antenna ground such as antenna ground 56. Antenna resonating element 52 may include a resonating element arm 54 (sometimes referred to herein as antenna resonating element arm 54, radiating arm 54, radiating element arm 54, or arm 54) that is shorted to antenna ground 56 by return path 55. Antenna 40 may be fed by coupling a transmission line (e.g., transmission line 38 of FIG. 3) to positive antenna feed terminal 44 and ground antenna feed terminal 46 of antenna feed 42. Positive antenna feed terminal 44 may be coupled to resonating element arm 54 and ground antenna feed terminal 46 may be coupled to antenna ground 56. Return path 55 may be coupled between resonating element arm 54 and antenna ground 56 in parallel with antenna feed 42.

The length of resonating element arm 54 may determine the response (e.g., resonant) frequency of the antenna. For example, the length of resonating element arm 54 may be approximately equal to (e.g., within 15% of) one-quarter of an effective wavelength corresponding to a frequency in the frequency band of operation of antenna 40 (e.g., where the effective wavelength is equal to a free space wavelength multiplied by a constant value associated with the dielectric material surrounding antenna 40). In the example of FIG. 3, antenna 40 includes only a single resonating element arm 54. This is merely illustrative. If desired, antenna 40 may include any desired number of resonating element arms or branches having any desired shapes and following any desired paths (e.g., for conveying signals in multiple frequency bands). Resonating element arm 54 may be formed using a conductive structure (e.g., a conductive trace or patch, sheet metal, conductive foil, etc.) that extends across a surface (e.g., a planar lateral area) above antenna ground 56 (e.g., resonating element arm 54 may have a width measured into and out of the plane of the page of FIG. 3), such that resonating element arm 54 forms a planar resonating element arm. In these scenarios, the inverted-F antenna structures of FIG. 3 form planar inverted-F antenna structures.

Figure 4:
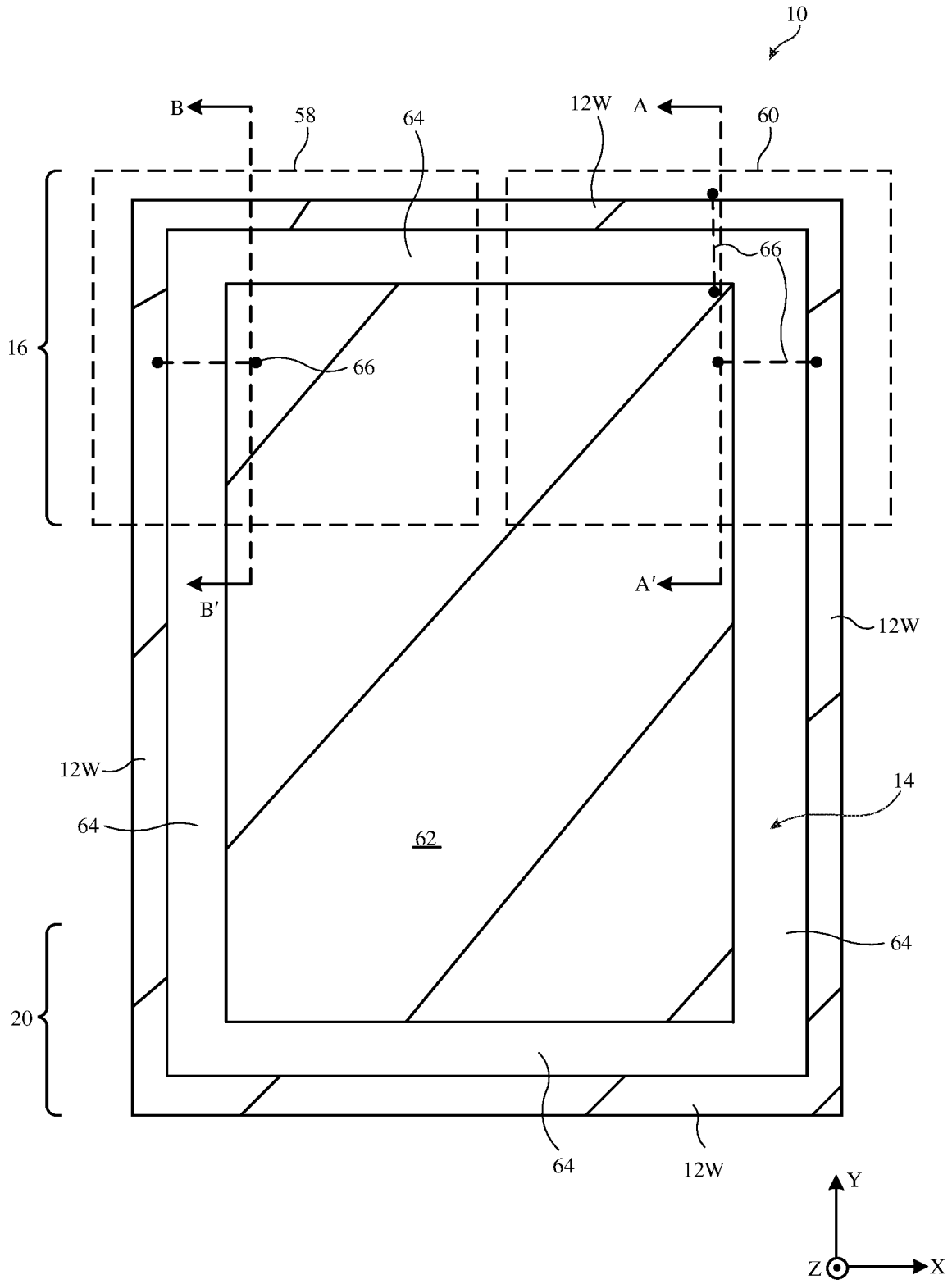
FIG. 4 is a top-down view of an illustrative electronic device having multiple antennas at different locations around a display in accordance with an embodiment.

FIG. 4 is a top-down view of device 10 showing different regions of device 10 that can be used to form antennas 40. As shown in FIG. 4, device 10 may include display 14. Display 14 may have a display module that is covered by a transparent display cover layer. The display module may emit light (e.g., images) through the display cover layer and/or may receive touch and/or force sensor input through the display cover layer. The display cover layer may be formed from glass, sapphire, plastic, or other materials. The display module may include stacked dielectric layers having pixel circuitry, touch sensor electrodes, force sensor circuitry, and/or other active components associated with emitting light and/or receiving input through the display cover layer. The display module may include conductive display structures such as conductive display structures 62 of FIG. 4 (e.g., conductive display structures 62 may form the display module for display 14). The display cover layer of display 14 is omitted from the example of FIG. 4 for the sake of clarity.

As shown in FIG. 4, conductive display structures 62 may be separated from conductive sidewalls 12W of device 10 by slots (gaps) 64. Slots 64 may, for example, define inactive area IA of display 14 (FIG. 1). Conductive display structures 62 may include a conductive frame for the active components of display 14, conductive layers in the display module (e.g., a conductive backplate for the display module or conductive layers embedded within the dielectric layers of the display module), conductive shielding structures, ground layers in display 14, and/or other conductive structures in display 14. If desired, conductive display structures 62 may include portions of the pixel circuitry, touch sensor circuitry, force sensor circuitry, and/or other components in the display module for display 14. Conductive display structures 62 may laterally extend across active area AA of FIG. 1, for example. As active area AA of display 14 is maximized, the space within device 10 occupied by the display module and conductive display structures 62 is also maximized, thereby limiting the amount of space available within device 10 for forming antennas 40.

Antennas 40 (FIG. 2) may be formed at upper end 16 of device 10 if desired. For example, device 10 may include a first antenna 40 within region 58 of upper end 16 and may include a second antenna 40 within region 60 of upper end 16. Regions 58 and 60 (e.g., antennas 40) may additionally or alternatively be located at lower end 20 or elsewhere on device 10 if desired. In general, device 10 may include any desired number of antennas 40 formed within any desired number of regions such as regions 58 and 60, at any desired locations around the periphery of device 10. Conductive sidewalls 12W may be used in forming antenna ground 56 (FIG. 3) for the antennas 40 within regions 58 and 60.

In practice, larger antenna volumes allow for greater antenna efficiency bandwidth. At the same time, larger slots 64 may increase the aperture size for the antennas, thereby increasing the overall antenna efficiency in radiating through slots 64 and the front face of device 10. As the size of active area AA (FIG. 1) increases, the size of slots 64 and thus the volume (e.g., aperture size) of the antennas decreases. Conductive display structures 62 may overlap and/or may be in close proximity to the antennas within regions 58 and 60. As the size of slots 64 is relatively small, the antennas located within regions 58 and 60 may have resonating element arms that at least partially overlap conductive display structures 62.

However, if care is not taken, conductive display structures 62 overlapping the antenna resonating element arms may undesirably block some of the radio-frequency signals conveyed by the antennas, particularly through display 14. This can reduce the efficiency and bandwidth of the antennas through the front face of device 10. In order to mitigate these effects, conductive display structures 62 may be coupled to ground (e.g., antenna ground 56 of FIG. 32) at one or more locations overlapping each antenna (e.g., within regions 58 and 60 of FIG. 4).

Conductive grounding structures such as grounding structures 66 may be used to couple conductive display structures 62 to conductive sidewalls 12W at one or more locations within regions 58 and 60 (e.g., overlapping each antenna aperture). Grounding structures 66 may have a first terminal coupled to conductive sidewalls 12W and a second terminal coupled to conductive display structures 62 (e.g., grounding structures 66 may bridge slot 64 and may overlap the antenna aperture for a corresponding antenna 40). This may couple the portion of conductive display structures 62 adjacent to each antenna aperture to a ground potential (e.g., antenna ground 56 of FIG. 3), thereby allowing radio-frequency signals for the antennas to pass through display 14 without being substantially blocked by conductive display structures 62.

Grounding structures 66 may overlap any desired locations within the antennas 40 of regions 58 and 60. In the example of FIG. 4, a single grounding structure 66 couples conductive display structures 62 to conductive sidewalls 12W within region 58 whereas two grounding structures 66 couple different locations on conductive display structures 62 to conductive sidewalls 12W within region 60. This is merely illustrative. Regions 58 and 60 may include any desired number of grounding structures 66. Grounding structures 66 may each include conductive wire, sheet metal, conductive foam, conductive adhesive, conductive fabric structures such as air loop gaskets, welds, solder, conductive screws, conductive springs, conductive pins, conductive tape, conductive portions of other device components such as conductive portions of a device switch (e.g., a volume or ringer switch), conductive portions of a camera module or camera bracket, conductive portions of a sensor module or sensor bracket, conductive portions of a speaker or speaker bracket, and/or any other desired conductive structures.

Figure 5:
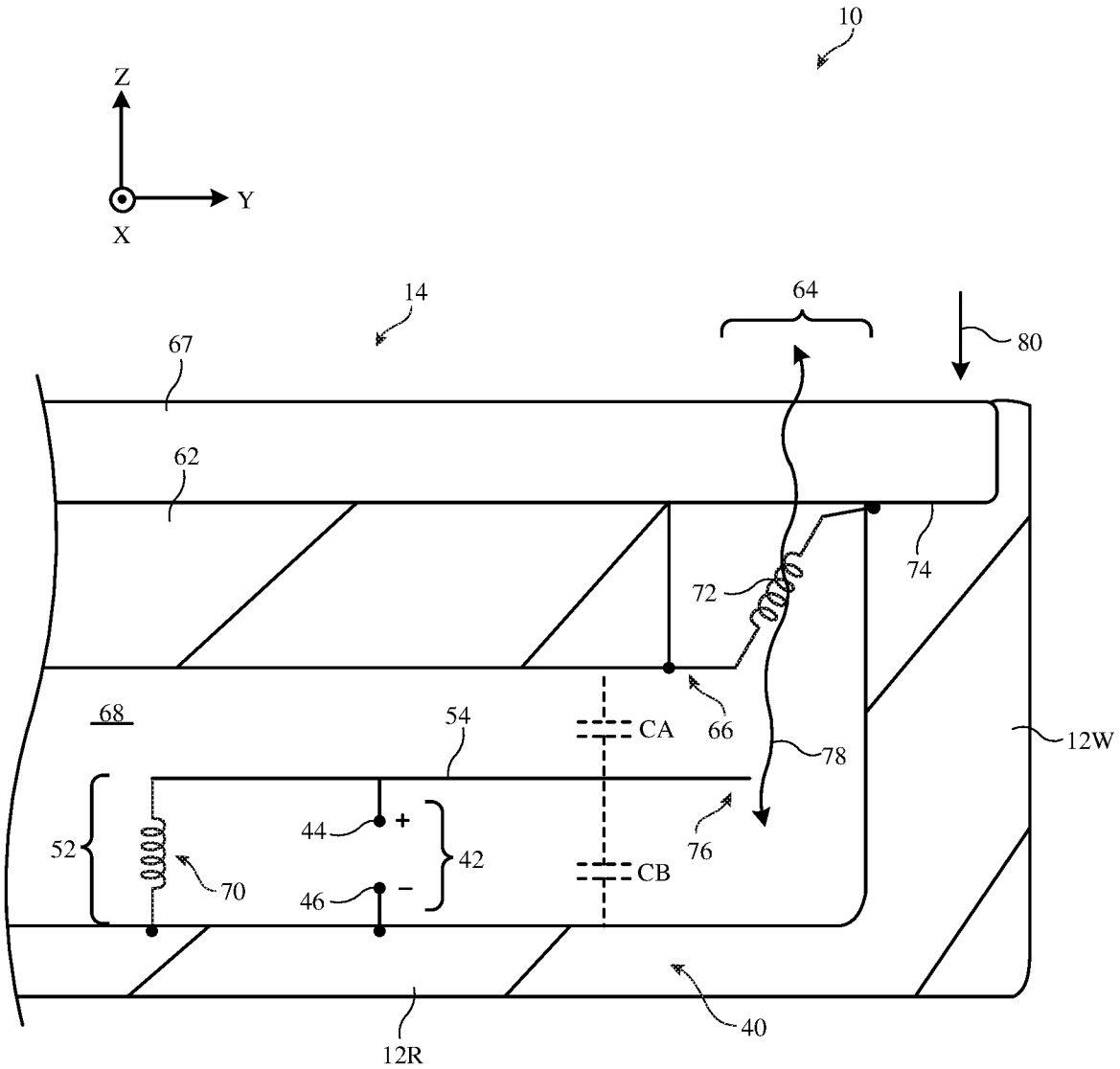
FIG. 5 is a cross-sectional side view of an illustrative antenna having a resonating element arm between a conductive display module and a conductive rear housing wall in accordance with some embodiments.

FIG. 5 is a cross-sectional side view of device 10 showing how a given antenna 40 may be formed within region 60 of device 10 (e.g., as taken along line AA' of FIG. 4). This is merely illustrative and, in another suitable arrangement, the antenna of FIG. 5 may be located within region 58 of FIG. 4 or elsewhere in device 10. As shown in FIG. 5, display 14 may include display cover layer 67 overlapping conductive display structures 62 (e.g., conductive display structures 62 may be mounted to the inner surface of display cover layer 67). Display cover layer 67 may be transparent and may be formed from any desired materials such as glass, plastic, or sapphire. Portions of display cover layer 67 may be provided with an opaque masking layer such as an ink layer if desired.

Display 14 may be mounted to conductive sidewalls 12W, one of which is illustrated in FIG. 5. Conductive sidewall 12W may have an inwardly-protruding portion (extension) 74 that is sometimes referred to herein as ledge 74 or datum 74. Ledge 74 may have a lateral surface that extends parallel to the inner surface of display cover layer 67. Display 14 may be secured to conductive sidewall 12W by coupling display cover layer 67 to ledge 74 using adhesive material.

Conductive display structures 62 may be separated from conductive rear housing wall 12R by interior cavity 68. Interior cavity 68 may be a conductive cavity having (conductive) edges defined by the conductive material in conductive rear housing wall 12R and conductive display structures 62. The lateral periphery of conductive display structures 62 may be separated from conductive sidewall 12W by a corresponding slot 64 (e.g., inactive area IA of FIG. 1). The antenna resonating element 52 for antenna 40 may be mounted within interior cavity 68 (e.g., resonating element arm 54 may be located within interior cavity 68).

Antenna feed 42 may be coupled between resonating element arm 54 and conductive rear housing wall 12R (e.g., across a portion of interior cavity 68). Positive antenna feed terminal 44 may be coupled to resonating element arm 54 whereas ground antenna feed terminal 46 is coupled to conductive rear housing wall 12R. Conductive rear housing wall 12R and conductive sidewall 12W may form the antenna ground for antenna 40 (e.g., antenna ground 56 of FIG. 3). An inductor such as inductor 70 may couple an end of resonating element arm 54 to ground (e.g., conductive rear housing wall 12R). Inductor 70 may form a return path for antenna resonating element 52 (e.g., return path 55 of FIG. 3). Resonating element arm 54 may extend from inductor 70 to an opposing tip 76. Antenna feed 42 may be coupled to resonating element arm 54 between tip 76 and inductor 70. Resonating element arm 54 may completely or partially overlap conductive display structures 62 such that some or all of antenna resonating element 52 is interposed within interior cavity 68 between conductive display structures 62 and conductive rear housing wall 12R (e.g., tip 76 may overlap conductive display structures 62 or may overlap slot 64).

If care is not taken, the presence of conductive display structures 62 may block antenna 40 from radiating through the front face of device 10, thereby limiting the overall antenna efficiency for antenna 40 through the front face of device 10. However, the presence of slot 64 may allow antenna 40 to convey radio-frequency signals 78 between interior cavity 68 and the free space exterior to device 10 (e.g., antenna 40 may transmit and/or receive radio-frequency signals 78 through slot 64 and display cover layer 67). If desired, interior cavity 68 may form a conductive cavity-back for antenna 40 that helps to optimize the radiation pattern and efficiency for antenna 40.

Resonating element arm 54 may extend across a lateral area that lies within the X-Y plane of FIG. 5 (e.g., resonating element arm 54 may be a planar inverted-F antenna resonating element arm). In practice, the lateral area of resonating element arm 54 may extend parallel to the bottom surface of conductive display structures 62. This may form a distributed capacitance such as distributed capacitance CA between resonating element arm 54 and conductive display structures 62. At the same time, an additional distributed capacitance CB may be present between resonating element arm 54 and conductive rear housing wall 12R. If care is not taken, distributed capacitance CA and/or distributed capacitance CB may undesirably detune the frequency response of antenna 40 (e.g., away from the frequency band of operation for antenna 40).

In order to mitigate the effects of distributed capacitance CA on the frequency response of antenna 40, an inductor such as inductor 72 may be coupled between conductive display structures 62 and conductive sidewall 12W. In this way, inductor 72 may be used to form a corresponding grounding structure 66 for antenna 40. The inductance of inductor 72 may be selected to cancel out the effects of distributed capacitance CA on antenna 40. Similarly, the inductance of inductor 70 may be selected to mitigate the effects of distributed capacitance CB on the frequency response of antenna 40. Inductors 70 and 72 may be formed from discrete components (e.g., discrete inductors such as surface mount inductors), segments of conductive material that exhibit a desired inductance, etc. Inductors 70 and/or 72 may include multiple inductors coupled in series and/or in parallel if desired. By compensating for the effects of distributed capacitances CA and CB, antenna 40 may convey radio-frequency signals 78 through slot 64 and display cover layer 67 with satisfactory antenna efficiency across the entire frequency band of operation for antenna 40.

Figure 6:
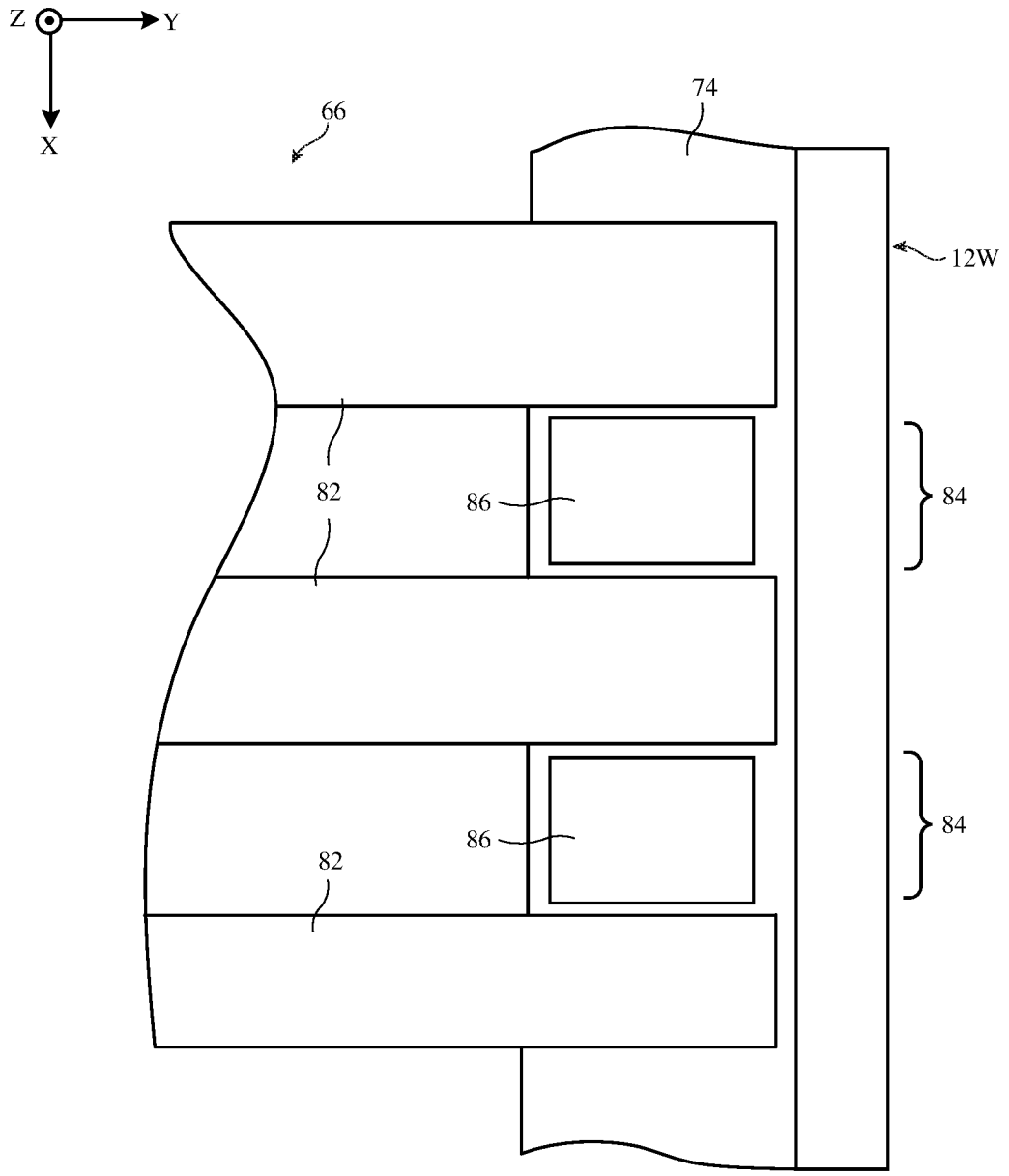
FIG. 6 is a top-down view of illustrative grounding structures having openings to accommodate adhesive for securing a display cover layer to a housing wall in accordance with some embodiments.

Grounding structure 66 may be coupled to ledge 74 of conductive sidewall 12W if desired. FIG. 6 is a top down view showing how grounding structure 66 may be coupled to ledge 74 (e.g., taken in the direction of arrow 80 of FIG. 5). Display cover layer 67 of FIG. 5 has been omitted from FIG. 6 for the sake of clarity.

As shown in FIG. 6, grounding structure 66 may include one or more strips of conductive adhesive 82. Conductive adhesive 82 may be, for example, conductive tape having one or two adhesive sides (surfaces). Conductive adhesive 82 may have a first end coupled to conductive display structures 62 (FIG. 5) and an opposing second end coupled to ledge 74 of conductive sidewall 12W. If desired, the first end of conductive adhesive 82 may be coupled to a terminal of inductor 72 (FIG. 5). In another suitable arrangement, conductive adhesive 82 may exhibit an inductance that is selected so that conductive adhesive 82 itself forms inductor 72 of FIG. 5. Conductive adhesive 82 (e.g., grounding structure 66) may form a conductive path to ground from conductive display structures 62 (FIG. 5). The second end of conductive adhesive 82 may help to secure (adhere) display cover layer 67 (FIG. 5) to conductive sidewall 12W. In this way, grounding structure 66 may optimize antenna efficiency and bandwidth through slot 64 for antenna 40 (FIG. 5) and may compensate for distributed capacitance CA (FIG. 5) while concurrently helping to attach display cover layer 67 and thus display 14 to conductive sidewall 12W.

The second end of conductive adhesive 82 at ledge 74 may have one or more openings such as openings (gaps) 84. Additional adhesive such as adhesive 86 may be coupled to ledge 74 within openings 84. Adhesive 86 may be, for example, pressure-sensitive adhesive that is activated by pressing display cover layer 67 (FIG. 5) onto conductive sidewall 12W and/or by heating. Adhesive 86 may adhere the display cover layer to ledge 74 more strongly than conductive adhesive 82. In this way, forming openings 84 in conductive adhesive 82 and filling openings 84 with adhesive 86 may help to increase the strength with which the display cover layer is secured to conductive sidewall 12W.

Figure 7:
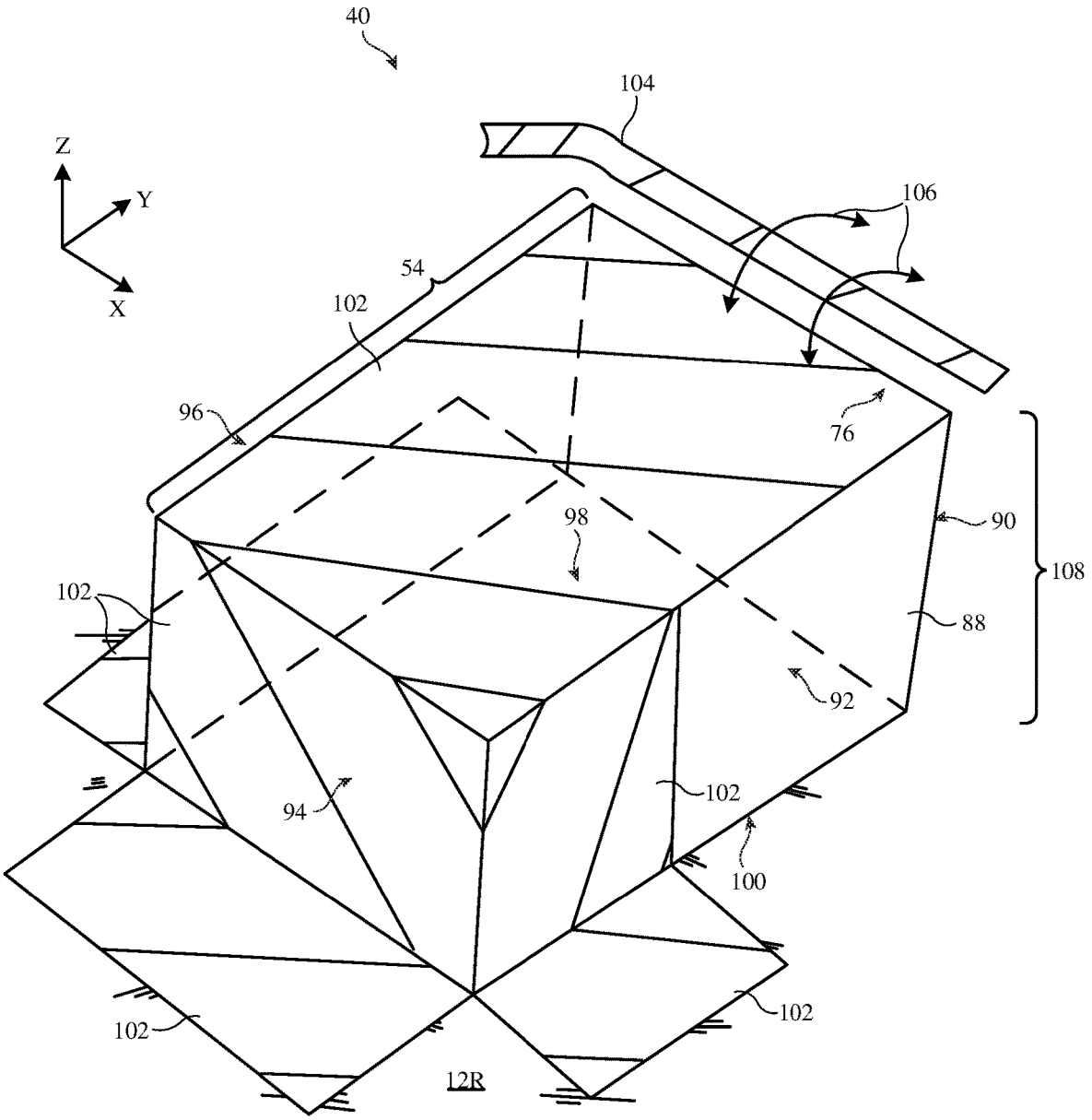
FIG. 7 is a perspective view of an illustrative antenna of the type shown in FIG. 5 having a monopole feed element in accordance with some embodiments.

FIG. 7 is a perspective view of antenna 40 within interior cavity 68 of FIG. 5. In the example of FIG. 7, display 14 and conductive sidewall 12W of FIG. 5 have been omitted for the sake of clarity. As shown in FIG. 7, antenna 40 may be formed from conductive structures 102 layered onto an underlying antenna support structure such as dielectric substrate 88. Dielectric substrate 88 may be formed from plastic, glass, ceramic, printed circuit board substrate, flexible printed circuit substrate, foam, or any other desired dielectric materials. Dielectric substrate 88 may be mounted to the interior surface of conductive rear housing wall 12R.

Conductive structures 102 may include conductive traces, sheet metal, conductive foil, conductive tape, and/or other conductive structures that are layered over dielectric substrate 88. A portion of conductive structures 102 may be formed on top surface 98 of dielectric substrate 88. An additional portion of conductive structures 102 may also be formed on side surfaces 92, 94, and/or 96 of dielectric substrate 88. If desired, portions of conductive structures 102 may also be layered onto conductive rear housing wall 12R. The portions of conductive structures 102 on conductive rear housing wall 12R may be soldered, welded, or otherwise placed into electrical contact with conductive rear housing wall 12R. The portions of conductive structures 102 on conductive rear housing wall 12R may serve to couple resonating element arm 54 to ground. As just one example, conductive structures 102 may include a single piece of conductive tape that is layered over top surface 98, that runs down sidewalls 92, 94, and 96, and that is folded onto conductive rear housing wall 12R. As another example, the portion of conductive structures 102 on top surface 98 may be formed from conductive traces patterned onto top surface 98 whereas the remainder of conductive structures 102 is formed from conductive tape that couples the conductive traces to conductive rear housing wall 12R (ground). These examples are merely illustrative.

Resonating element arm 54 of antenna 40 may be formed from the portion of conductive structures 102 on top surface 98 of dielectric substrate 88. The return path for antenna 40 (e.g., return path 55 of FIG. 3) may be formed the portion of conductive structures 102 on sidewalls 96, 94, and/or 92 of dielectric substrate 88. The amount of conductive material on sidewalls 96, 94, and/or 92 may be selected so that the conductive material on sidewalls 96, 94, and/or 92 exhibits the inductance of inductor 70 of FIG. 5 (e.g., the portion of conductive structures 102 covering sidewalls 96, 94, and/or 92 may form inductor 70 of FIG. 5). The portions of dielectric substrate 88 that are not covered by conductive material (e.g., sidewall 90 and a portion of sidewall 92) may form a radiating aperture 108 for resonating element arm 54.

Antenna 40 may be fed using any desired feed structures. For example, antenna 40 may be fed using a coaxial feed, conductive feed vias extending through dielectric substrate 88, or any other desired feed structures. In the example of FIG. 7, antenna 40 is indirectly fed using monopole feed element 104. As shown in FIG. 7, monopole feed element 104 may extend parallel to the width of tip 76 of resonating element arm 54. Monopole feed element 104 may be coupled to signal conductor 48 of FIG. 2, for example. Antenna currents on monopole feed element 104 may excite corresponding antenna currents (e.g., in the frequency band of operation for antenna 40) on resonating element arm 54 via near-field electromagnetic (e.g., capacitive) coupling 106. The antenna currents excited on resonating element arm 54 may radiate radio-frequency signals 78 of FIG. 5. Similarly, received radio-frequency signals 78 may produce antenna currents on resonating element arm 54, which are then received by monopole feed element 104 via near-field electromagnetic coupling 106. Monopole feed element 104 may exhibit a relatively narrow profile (parallel to the Y-axis of FIG. 7) that allows monopole feed element 104 to fit within slot 64 (FIG. 5) without requiring additional device volume to feed antenna 40.

The example of FIG. 7 is merely illustrative. Antenna 40 may be fed using any desired feed structures. Dielectric substrate 88 may have any desired shape having any desired number of planar and/or curved sides. Resonating element arm 54 may have any desired shape having any desired number of curved and/or straight edges. Conductive structures 102 may cover all of sidewall 92 and/or some of sidewall 90 of dielectric substrate 88 if desired. Conductive structures 102 may cover some, all, or none of sidewall 96 and/or some, all, or none of sidewall 94 if desired.

Figure 8:
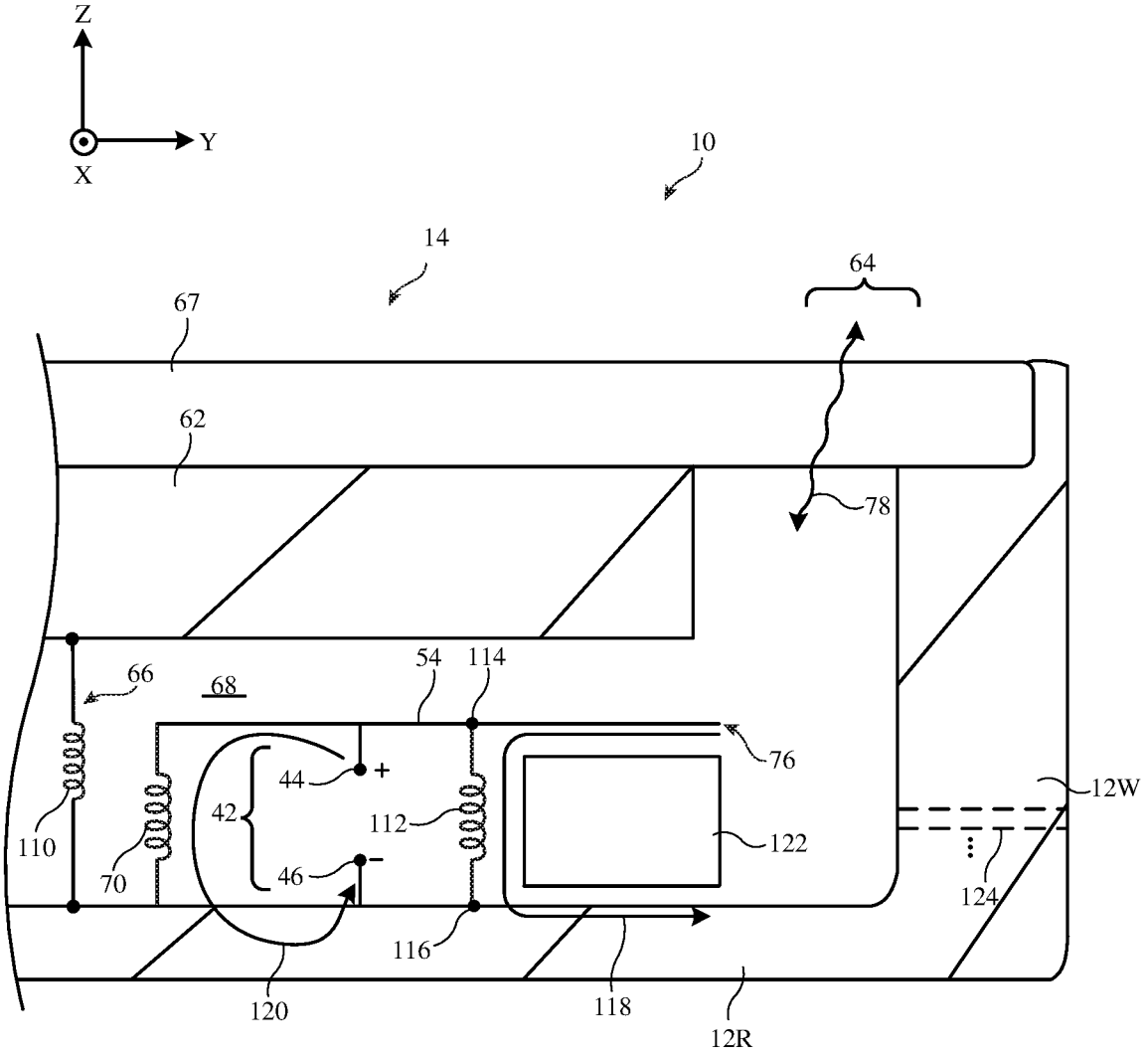
FIG. 8 is a cross-sectional side view of an illustrative antenna having multiple current loop paths to accommodate a device component in accordance with some embodiments.

FIG. 8 is a cross-sectional side view of device 10 showing how a given antenna 40 may be formed within region 58 of device 10 (e.g., as taken along line BB' of FIG. 4). This is merely illustrative and, in another suitable arrangement, the antenna of FIG. 8 may be located within region 60 of FIG. 4 or elsewhere in device 10.

As shown in FIG. 8, resonating element arm 54 for antenna 40 may be mounted within interior cavity 68 and may be coupled to conductive rear housing wall 12R by inductor 70. Inductor 70 may form the return path for antenna 40 and may have an inductance that compensates for detuning caused by the distributed capacitance between resonating element arm 54 and conductive rear housing wall 12R (e.g., distributed capacitance CB of FIG. 5). A device component such as device component 122 may be interposed between a portion of resonating element arm 54 and conductive rear housing wall 12R (e.g., at tip 76). Device component 122 may include one of input-output devices 32 (FIG. 2) or other components for device 10. An example in which device component 122 is a speaker for device 10 is sometimes described herein as an example. In these scenarios, openings such as speaker port 124 may be formed in conductive sidewall 12W. Speaker port 124 may allow sound emitted by device component 122 to pass to the exterior of device 10. By co-locating device component 122 and antenna 40, space consumption within device 10 may be minimized.

The example of FIG. 8 shows a single grounding structure 66 coupled between conductive display structures 62 and conductive rear housing wall 12R for the sake of clarity. In general, any desired number of grounding structures 66 may be coupled between conductive display structures 62 and conductive sidewall 12W (e.g., across slot 64) and/or between conductive display structures 62 and conductive rear housing wall 12R. Grounding structure 66 may include an inductor such as inductor 110. Inductor 110 may have an inductance that is selected to compensate for detuning caused by the distributed capacitance between resonating element arm 54 and conductive display structures 62 (e.g., distributed capacitance CA of FIG. 5). Inductor 110 may be formed from a discrete component, segments of conductive traces that exhibit a desired inductance, etc. Inductor 110 may include multiple discrete inductors coupled in series and/or in parallel if desired.

If care is not taken, the presence of device component 122 at tip 76 may undesirably limit the overall antenna efficiency and/or bandwidth for antenna 40. In order to mitigate these effects, an inductive structure such as inductor 112 may be coupled between resonating element arm 54 and conductive rear housing wall 12R. Inductor 112 may have a first terminal 114 coupled to resonating element arm 54 and a second terminal 116 coupled to conductive rear housing wall 12R. First terminal 114 may be interposed on resonating element arm 54 between inductor 70 and tip 76 (e.g., between positive antenna feed terminal 44 and tip 76). Second terminal 116 may be interposed on conductive rear housing wall 12R between inductor 70 and conductive sidewall 12W (e.g., between ground antenna feed terminal 46 and conductive sidewall 12W). Inductor 112 may be formed from a discrete inductor or from any other desired conductive structures (e.g., conductive traces, sheet metal, conductive foil, conductive tape, etc.).

Including an additional inductor such as inductor 112 in antenna 40 may establish multiple current loop paths on antenna 40. For example, the antenna currents on antenna 40 (e.g., in the frequency band of operation for antenna 40) may follow a first current loop path 120 from positive antenna feed terminal 44, through a portion of resonating element arm 54, through inductor 70, and through a portion of conductive rear housing wall 12R to ground antenna feed terminal 46. At the same time, the antenna currents on antenna 40 (e.g., in the frequency band of operation for antenna 40) may follow a second current loop path 118 from tip 76, through a portion of resonating element arm 54, through inductor 112, and through a portion of conductive rear housing wall 12R (e.g., around device component 122). The antenna current on current loop paths 120 and the antenna current on current loop path 118 may each contribute to the radiative response (resonance) of antenna 40 in the frequency band of operation for antenna 40. Distributing the antenna current in this way may help the antenna currents to bypass device component 122, thereby maximizing antenna efficiency and bandwidth for antenna 40 in conveying radio-frequency signals 78 through slot 64 and display cover layer 67, despite the fact that antenna 40 is co-located with device component 122 within interior cavity 68.

Figure 9:
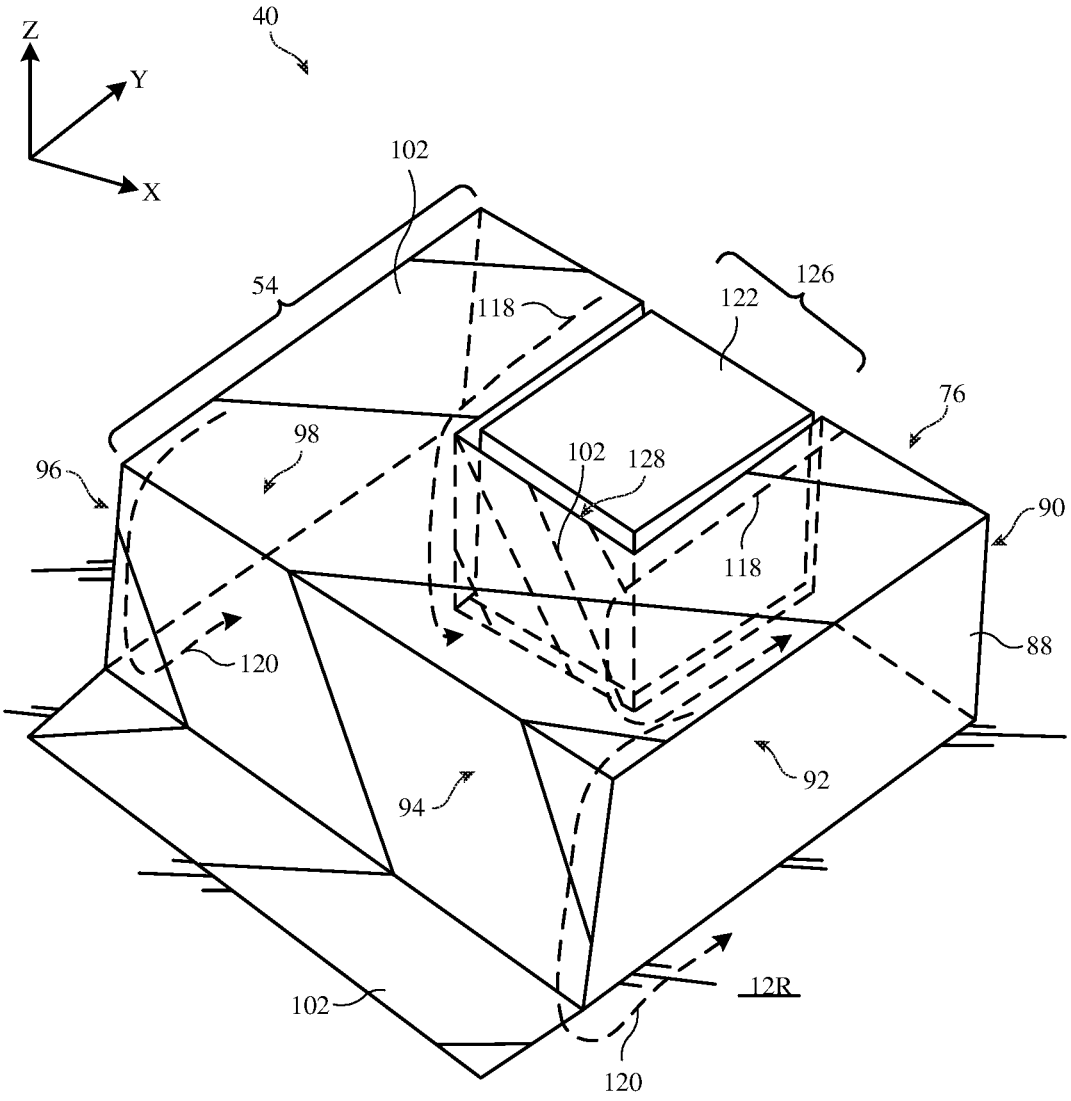
FIG. 9 is a perspective view of an illustrative antenna of the type shown in FIG. 8 in accordance with some embodiments.

FIG. 9 is a perspective view of antenna 40 and device component 122 of FIG. 8. In the example of FIG. 9, display 14 and conductive sidewall 12W of FIG. 5 have been omitted for the sake of clarity. As shown in FIG. 9, dielectric substrate 88 may include a notch (e.g., at tip 76 of resonating element arm 54) such as notch 126 that accommodates device component 122. Notch 126 may sometimes be referred to herein as opening 126. Device component 122 may be mounted to conductive rear housing wall 12R within notch 126.

The portion of conductive structures 102 on top surface 98 of dielectric substrate 88 may form resonating element arm 54. The portion(s) of conductive structures 102 on sidewalls 94, 92, and/or 96 of dielectric substrate 88 may form the return path and inductor 70 (FIG. 8) for antenna 40. In the example of FIG. 9, conductive structures 102 only cover sidewall 94 whereas sidewalls 92, 96, and 90 are free from conductive material. This is merely illustrative. The portion(s) of conductive structures 102 on conductive rear housing wall 12R may be soldered, welded, or otherwise placed into electrical contact with conductive rear housing wall 12R. The portions of conductive structures 102 on conductive rear housing wall 12R may serve to couple resonating element arm 54 to ground.

As shown in FIG. 9, dielectric substrate 88 may have an additional sidewall 128 within notch 126 (e.g., notch 126 may have an open end at the side of device component 122 facing speaker port 124 of FIG. 8 and may have an opposing closed end defined by additional sidewall 128 of dielectric substrate 88). A portion of conductive structures 102 may run down sidewall 128 to couple resonating element arm 54 to conductive rear housing wall 12R within notch 126. Antenna currents may flow from tip 76, through the portion of conductive structures 102 on top surface 98, and down the portion of conductive structures 102 on sidewall 128 to conductive rear housing wall 12R (e.g., along current loop path 118). In this way, the portion of conductive structures 102 on sidewall 128 may form inductor 112 of FIG. 8. One or more discrete inductors may additionally or alternatively be used to form inductor 112 of FIG. 8. In other words, the portion of resonating element arm 54 extending from sidewall 128 (e.g., inductor 112 of FIG. 8) to tip 76 may laterally surround or extend along two opposing sides of device component 122. At the same time, antenna currents may flow down the portion of conductive structures 102 on sidewall 94 to conductive rear housing wall 12R (e.g., along current loop path 120). Distributing the antenna current in this way may help the antenna currents to bypass device component 122 (e.g., within the frequency band of operation for antenna 40), thereby maximizing antenna efficiency and bandwidth for antenna 40 despite the fact that antenna 40 is co-located with device component 122.

The example of FIG. 9 is merely illustrative. Antenna 40 may be fed using any desired feed structures. Dielectric substrate 88 may have any desired shape having any desired number of planar and/or curved sides. Resonating element arm 54 may have any desired shape having any desired number of curved and/or straight edges. Conductive structures 102 may cover some or all of sidewall 94 and some or all of sidewall 128. Conductive structures 102 may cover some or all of sidewalls 92, 96, and/or 90. Notch 126 may have any desired shape having any desired number of curved and/or straight sides (e.g., as defined by the form of device component 122 and dielectric substrate 88).

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a conductive housing having a rear wall and a sidewall;

a display mounted to the sidewall, wherein the display comprises a conductive display structure and a display cover layer overlapping the conductive display structure, the conductive display structure being separated from the sidewall by a slot;

an antenna arm coupled to the rear wall, wherein the antenna arm is interposed between the rear wall and the conductive display structure, a portion of the antenna arm extending across an area overlaps a portion of the conductive display structure, and the overlapping portions of the antenna arm and the conductive display structure exhibit a distributed capacitance, the antenna arm being configured to radiate through the slot and the display cover layer; and an inductor coupled between the conductive display structure and the conductive housing, wherein the inductor is configured to compensate for the distributed capacitance between the overlapping portions of the antenna arm and the conductive display structure.

2. The electronic device of claim 1, further comprising:

an additional inductor coupled between the antenna arm and the rear wall, wherein the additional inductor is configured to compensate for an additional distributed capacitance between the antenna arm and the rear wall.

3. The electronic device of claim 2, further comprising:

a dielectric substrate mounted to the rear wall, wherein the antenna arm is on the dielectric substrate; and a conductive structure layered on the dielectric substrate, wherein the conductive structure is configured to form the antenna arm and the additional inductor.

4. The electronic device of claim 3, wherein the dielectric substrate has a notch, the conductive structure having a portion that is coupled to the rear wall within the notch.

5. The electronic device of claim 4, further comprising:

a speaker mounted to the rear wall within the notch.

6. The electronic device of claim 4, further comprising:

an antenna feed coupled to the antenna arm at a point between the notch and the additional inductor, wherein a first segment of the antenna arm from the antenna feed to the additional inductor, the additional inductor, and a first portion of the rear wall form a first current loop path, and wherein a second segment of the antenna arm from a tip of the antenna arm to the portion of the conductive structure, the portion of the conductive structure, and a second portion of the rear wall form a second current loop path, the first and second current loop paths being configured to contribute to a radiative response of the antenna arm.

7. The electronic device of claim 3, wherein the dielectric substrate has first, second, third, fourth, and fifth sides, the conductive structure has a first portion on the first side that forms the antenna arm, the conductive structure has a second portion on at least some of the second, third, and fourth sides, the second portion forms the additional inductor, and the fifth side and a portion of the fourth side form an aperture for the antenna arm that is not covered by the conductive structure.

8. The electronic device of claim 7, wherein the conductive structure comprises conductive tape.

9. The electronic device of claim 1, wherein the inductor couples the conductive display structure to the sidewall across the slot.

10. The electronic device of claim 9, further comprising:

conductive tape that couples an end of the inductor to a ledge of the sidewall, wherein the conductive tape is configured to adhere the display cover layer to the sidewall.

11. The electronic device of claim 10, wherein the conductive tape comprises at least one gap, the electronic device further comprising:

adhesive on the ledge within the at least one gap, wherein the adhesive is configured to adhere the display cover layer to the sidewall.

12. The electronic device of claim 1, wherein the inductor couples the conductive display structure to the rear wall.

13. The electronic device of claim 1, wherein an entirety of the antenna arm is interposed between the conductive display structure and the rear wall.

14. The electronic device of claim 1, further comprising:

a monopole feed element configured to feed the antenna arm via near-field electromagnetic coupling.

15. An electronic device comprising:

a display having a conductive display structure and a display cover layer overlapping the conductive display structure;

a conductive housing wall;

a conductive sidewall extending from the conductive housing wall to the display cover layer, wherein a periphery of the conductive display structure is separated from the conductive sidewall by a slot;

an interior cavity having opposing edges defined by the conductive display structure and the conductive housing wall;

a dielectric substrate mounted to the conductive housing wall within the interior cavity; and a planar inverted-F antenna formed from conductive structures on the dielectric substrate, wherein a first portion of the conductive structures on a top surface of the dielectric substrate is disposed between the conductive display structure and the conductive housing wall, a second portion of the conductive structures on a side surface of the dielectric substrate extends from the first portion of the conductive structures to the conductive housing wall, and the planar inverted-F antenna is configured to convey radio-frequency signals through the slot and the display cover layer.

16. The electronic device of claim 15 further comprising:

an inductor that couples the conductive display structure to the conductive sidewall across the slot.

17. The electronic device of claim 15, wherein the first portion of the conductive structures forms a resonating element arm and the second portion of the conductive structures forms a return path for the planar inverted-F antenna that couples the resonating element arm to the conductive housing wall.

18. The electronic device of claim 15, wherein the second portion of the conductive structures forms an inductor, the first portion of the conductive structures forms a resonating element arm that extends from the inductor to a tip, and the tip is interposed between the conductive display structure and the conductive housing wall.

19. An electronic device comprising:

a display having a conductive display structure and a display cover layer overlapping the conductive display structure;

a conductive housing wall;

a conductive sidewall extending from the conductive housing wall to the display cover layer;

an antenna resonating element arm interposed between the conductive display structure and the conductive housing wall;

an antenna feed coupled to the antenna resonating element arm and the conductive housing wall;

a first inductor that couples an end of the antenna resonating element arm to the conductive housing wall, wherein the first inductor is separated from the antenna feed by a first portion of the antenna resonating element arm and the antenna resonating element arm has a tip opposite the end;

a second inductor that couples the antenna resonating element arm to the conductive housing wall, wherein the second inductor is separated from the tip by a second portion of the antenna resonating element arm; and a speaker mounted to the conductive housing wall, wherein the second portion of the antenna resonating element arm extends along two opposing sides of the speaker.

20. The electronic device of claim 19, wherein a periphery of the conductive display structure is separated from the conductive sidewall by a slot, the first portion of the antenna resonating element arm, the first inductor, and a first portion of the conductive housing wall form a first current loop path, the second portion of the antenna resonating element arm, the second inductor, and a second portion of the conductive housing wall form a second current loop path, and the first and second current loop paths are configured to radiate radio-frequency signals through the slot and the display cover layer.

* * * * *